137-331

7/1/86 SR

OR 4,597,408

United States Patent [19]

Canter

[11] Patent Number: 4,597,408

[45] Date of Patent: Jul. 1, 1986

[54] ROTATING POPPET VALVE SYSTEM

[76] Inventor: Mark A. Canter, 1308 Dexter Dr., West, Port Orange, Fla. 32019

[21] Appl. No.: 746,746

[22] Filed: Jun. 20, 1985

[51] Int. Cl.[4] ..... F16K 29/00; F01L 1/32

[52] U.S. Cl. ..... 137/331; 123/90.29; 123/90.67

[58] Field of Search ..... 123/90.28, 90.29, 90.67; 137/330, 331

[56] References Cited

U.S. PATENT DOCUMENTS

| | | | |
|---|---|---|---|
| 1,244,287 | 10/1917 | Buck | 137/331 |
| 1,297,342 | 3/1919 | Garlick | 123/90.28 |
| 1,470,102 | 10/1923 | Rahm | 123/90.28 |
| 1,513,075 | 10/1924 | Trembley | 123/90.28 |
| 2,165,239 | 7/1939 | Douglas et al. | 123/90.29 |
| 2,841,128 | 7/1958 | Aiken | 123/90.29 |
| 2,863,427 | 12/1958 | Newton | 123/90.29 |
| 3,890,943 | 6/1975 | Schonlau et al. | 137/331 |

FOREIGN PATENT DOCUMENTS

| | | | |
|---|---|---|---|
| 812595 | 3/1937 | France | 123/90.28 |

*Primary Examiner*—G. L. Walton

*Attorney, Agent, or Firm*—Macdonald J. Wiggins

[57] ABSTRACT

A poppet valve has a threaded end of its stem. A coiled valve spring is provided with a valve spring retainer having a central bore for the valve stem, a circular groove for the spring, and a first ball bearing race on the opposite face from the spring groove. A valve retainer has a threaded bore and a second ball bearing race. A set of ball bearings is disposed in the spring retainer race, the valve stem is inserted through the spring and spring retainer, and the valve retainer is threaded onto the valve stem engaging the ball bearings by the second race. The ball bearing assembly thus permits the valve to rotate with respect to the spring and spring retainer during operation. A lock nut is used to lock the assembly.

2 Claims, 3 Drawing Figures

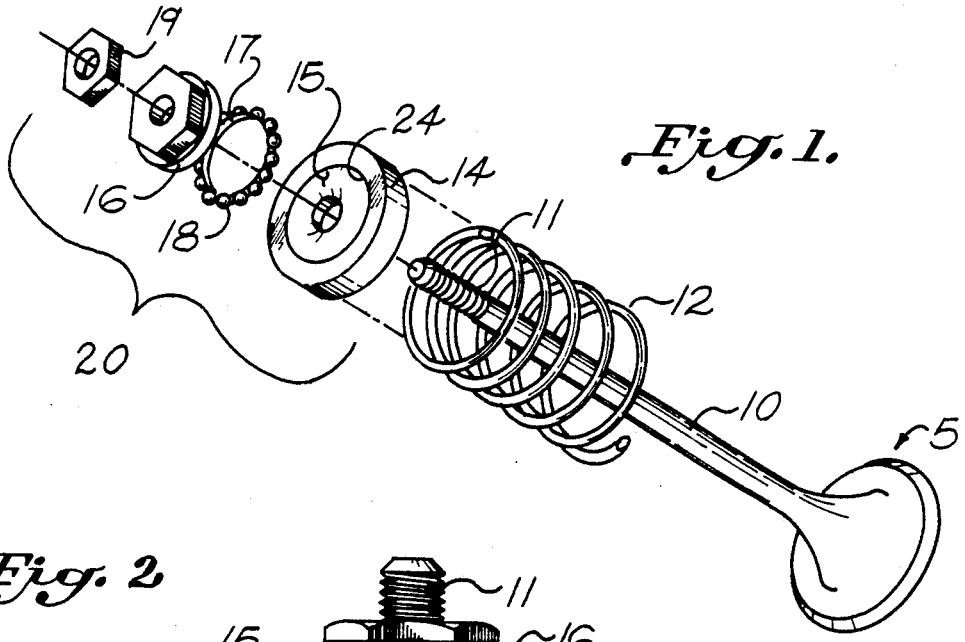
Fig. 1.
Fig. 2
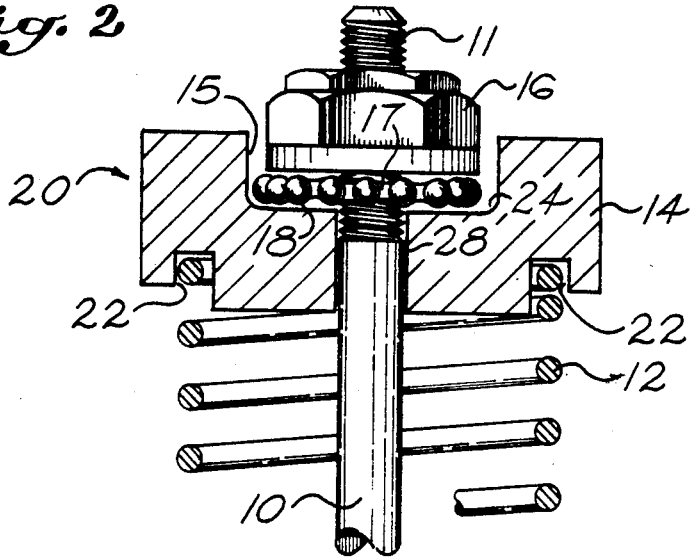
Fig. 3
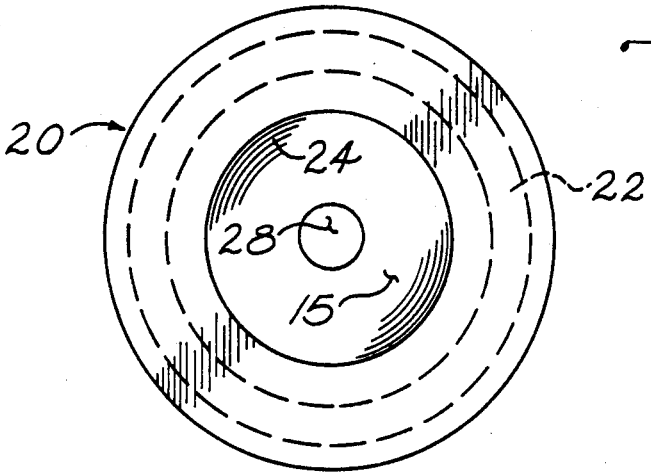

ROTATING POPPET VALVE SYSTEM

BACKGROUND OF THE INVENTION

1. Field of the Invention

The present invention relates to poppet valves for internal combustion engines, and more particularly to a system for permitting a poppet valve to rotate during engine operation.

2. Background of the Invention

It is well known that rotation of a poppet valve in use will increase the life of the valve since the same area of the valve is not continuously presented to the combustion gases. Warping is reduced and carbon deposit is not as likely to take place on the valve seats or faces. With some conventional valve retainers, the valve springs have been attached to prevent rotation. Others that permit rotation can permit the keepers to come loose from the valve stem resulting in loss of the valve. Attempts have been made in the prior art to provide a rotatable poppet valve. For example, Douglas et al, U.S. Pat. No. 2,165,239 shows a design in which the valve is free to rotate. A cage for a set of ball bearings which rides on a race formed in the valve stem is taught by Aiken, U.S. Pat. No. 2,841,128. Although the Aiken design permits the valve to rotate, it requires that a precision race be provided on each valve stem which can add greatly to the cost of the valve and also presents a weak point in the valve stem.

Thus, there is a need for a simple, low cost system for poppet valves which will permit the valve to rotate during operation and which will overcome the disadvantages of the prior art attempts to solve this problem.

SUMMARY OF THE INVENTION

My rotatable poppet valve assembly utilizes a conventional poppet valve having the ends of the valve stem threaded to accept a threaded valve retainer. A valve spring retainer formed from suitably hardened steel is provided having a circular groove on one side thereof for accepting the valve spring and a bearing race on the opposite side. The valve is installed, the spring placed in position, and the valve spring retainer installed onto the valve stem and spring. A valve retainer and race asembly has internal threads which match the valve stem threads and is threaded onto the end of the valve stem. The valve retainer and race assembly includes, at the inner portion thereof, a ball bearing race complementary to the race in the valve spring retainer. A set of ball bearings is installed in the race and the valve retainer tightened to produce the desired spring tension. After the tension is set, a lock nut is threaded onto the outer end of the threaded valve stem and tightened to lock the valve retainer and race assembly in place. As will now be recognized, the valve is free to rotate with respect to the valve spring retainer without danger of the retainer coming loose from the valve stem.

It is therefore a principal object of my invention to provide a poppet valve having a retaining system which permits the valve to rotate during operation of the engine. It is another object of my invention to provide a valve spring retainer having a ball bearing race therein, a valve stem threded to accept a valve retainer and race assembly having ball bearings which are disposed in the valve spring retainer race.

It is still another object of my invention to provide a poppet valve having a threaded valve stem in which the valve retainer and race assembly can be locked in place by a lock nut.

These and other objects and advantages of my invention will become apparent from the following detailed description when read in conjunction with the drawings.

BRIEF DESCRIPTION OF THE DRAWINGS

FIG. 1 is an exploded perspective view of the valve, valve spring, and retainer assembly in accordance with my invention;

FIG. 2 is a cross-sectional view of the valve spring retainer and spring showing the valve stem and valve retainer and race assembly in place; and FIG. 3 is a top view of the valve retainer and race assembly of the invention.

DETAILED DESCRIPTION OF THE PREFERRED EMBODIMENT

Referring first to FIG. 1, the elements of my rotatable valve system are shown. A conventional poppet valve shown generally at 5 includes a valve stem 10. Valve stem 10 is provided with threads at its outer end 11. Circular valve spring retainer 14 is provided having in its outer surface counterbore 15 and ball bearing race 24, and in its undersurface (not shown in FIG. 1) a circular groove 22 for receiving valve spring 12. Next, circular valve retainer 16 has a race 17 provided. The set of ball bearings 18 installed over the race portion thereof. Ball bearings 18 may be assembled in a conventional bearing cage, not shown.

Valve retainer 16 and race 17 includes a concentric internally threaded portion adapted to receive threaded end 11 of valve stem 10. A lock nut 19 is provided to securely lock valve retainer and race assembly in its operating position.

The construction of the rotating valve assembly of my invention will be better understood with reference to FIG. 2 which shows the retainer assembly 20 in more detail. Valve spring retainer 14 is shown in cross-sectional view in FIG. 2 and in top view in FIG. 3. As will be noted, circular groove 22 is provided in the underside of valve spring retainer 14 for accepting valve spring 12 shown partially and in cross-sectional view in FIG. 2. Counterbore 15 in the top surface of valve spring retainer 14 defines a bearing race 24. Valve stem 10 is inserted through central bore 28 in valve spring retainer 14 and the valve retainer 16 and race 17 with ball bearings 18 is threaded onto the threaded end 11 of valve stem 10. As will be seen, the outer part of valve retainer 16 is formed to accept a hexagonal wrench.

Lock nut 19 is also threaded onto valve stem threads 11 and the valve retainer 16 adjusted to produce the desired valve spring tension whereupon lock nut 19 is securely tightened tohold valve retainer 16 and race 17 in place. As will now be recognized, valve 5 is free to rotate with respect to spring 12 and spring retainer 14 with no tendency for valve retainer 16 to come loose from valve stem 10

Although I have described a preferred embodiment, it will be obvious to those of skill in the art that various modifications may be made to the design without departing from the spirit or scope of the invention.

I claim:

1. A rotatable poppet valve assembly comprising:

a poppet valve having a valve stem,, said valve stem threaded at its outer end;

a valve spring;

a circular valve spring retainer having parallel circular inner and outer surfaces, and a concentric bore therethrough, said outer surface having a concentric counterbore defining a first ball bearing race and said inner surface having a concentric circular groove for receiving said valve spring, said valve stem disposed through said concentric bore;

a valve retainer having a second ball bering race and a axially thraded bore;

a set of ball bearings disposed in said first ball bearing race and said valve retainer threaded onto said valve stem to engage said set of ball bearings with said second ball bearing race of said valve retainer within said counterbore, said valve retainer threadable for adjusting the tension of said valve spring; and a lock nut threaded on said outer end of said valve stem for locking said valve retainer to said valve stem within said counterbore and thereby maintaining said ball bearings with said ball bearing race.

2. In a poppet valve having a threaded stem and a coiled valve spring, a valve retainer assembly comprising:

a circular valve spring retainer having a central bore therethrough, a first surface having a concentric groove for accepting said coiled valve spring and a second surface having a concentric first ball bearing race therein;

a circular valve retainer having a threaded central bore therethrough and a concentric second ball bearing race thereon;

a set of all bearings;

a lock nut; and said threaded valve stem disposed through said coiled spring and said central bore of said valve spring retainer, said coiled spring seated in said concentric groove, said set of ball bearings seated in said first race, said valve retainer threaded onto said valve stem to cause said second race to seat in said set of ball bearings, and said lock nut threaded onto said valve stem to thereby lock and maintain said valve retainer and said second race seated within said ball bearings.

* * * * *